US009028287B2

(12) United States Patent
Doyle et al.

(10) Patent No.: US 9,028,287 B2
(45) Date of Patent: May 12, 2015

(54) WATERSPORT PADDLE

(71) Applicant: CVC Sports, Inc., Rocklin, CA (US)

(72) Inventors: Michael D. Doyle, Loomis, CA (US); Lorrie L. Doyle, Loomis, CA (US)

(73) Assignee: CVC Sports, Inc., Rocklin, CA (US)

( * ) Notice: Subject to any disclaimer, the term of this patent is extended or adjusted under 35 U.S.C. 154(b) by 0 days.

(21) Appl. No.: 14/211,626

(22) Filed: Mar. 14, 2014

(65) Prior Publication Data

US 2014/0273674 A1 Sep. 18, 2014

Related U.S. Application Data

(60) Provisional application No. 61/791,802, filed on Mar. 15, 2013.

(51) Int. Cl.
*B63H 16/04* (2006.01)

(52) U.S. Cl.
CPC ..... *B63H 16/04* (2013.01)

(58) Field of Classification Search
CPC ..... B63H 16/04; B63H 16/10
USPC ..... 440/101, 102
See application file for complete search history.

(56) References Cited

U.S. PATENT DOCUMENTS

| | | | | |
|---|---|---|---|---|
| 5,062,816 | A * | 11/1991 | Berglund et al. | 440/101 |
| 6,254,444 | B1 * | 7/2001 | Nordby | 440/101 |
| 6,328,617 | B1 * | 12/2001 | Gunnell | 440/101 |
| 6,796,862 | B1 * | 9/2004 | Abbenhouse et al. | 440/101 |
| 7,488,228 | B2 * | 2/2009 | Scott | 440/101 |
| 8,371,886 | B1 * | 2/2013 | Strangfeld | 440/101 |
| 2014/0273674 | A1 * | 9/2014 | Doyle et al. | 440/101 |

* cited by examiner

*Primary Examiner* — Lars A Olson
*Assistant Examiner* — Jovon Hayes
(74) *Attorney, Agent, or Firm* — Bateman IP

(57) ABSTRACT

The present invention relates to a watersport paddle blade comprising a throat configured to attach to a shaft, a power face attached to the throat, wherein the power face comprises a main channel beginning at or near the throat, extending along the center of the face and opening at a distal end of the blade, and a plurality of side channels connected to the center channel, wherein the side channels are slanted and extend from the lateral edge inwardly toward the center channel and are angled downwardly toward the distal end of the blade.

17 Claims, 5 Drawing Sheets

WATERSPORT PADDLE

THE FIELD OF THE INVENTION

The present invention relates to novel watersport paddles, in particular to the design of paddle blades.

BACKGROUND

Watersport paddles have been subject to little design innovation, having been based on standard shapes and contours for many years. Accordingly, little effort has been devoted to improvements in paddle stroke efficiency, stability (avoiding flutter), and user comfort.

With significant improvements in lightweight materials used in the construction of watersport paddles, new attention is being made to improving the actual structure and function of the watersport paddle blades. U.S. Pat. No. 7,488,228, for example, discloses a watersport paddle having a longitudinal arc shaped blade.

The present invention, as described and claimed below, represents an improvement in the design and function of watersport paddles.

SUMMARY OF INVENTION

The present invention relates to a watersport paddle blade comprising a throat configured to attach to a shaft, a power face attached to the throat, wherein the power face comprises a main channel beginning at or near the throat, extending along the center of the face and opening at a distal end of the blade, and a plurality of side channels connected to the main channel.

In another aspect, the invention provides a watersport paddle blade comprising a throat configured to attach to a shaft; a power face attached to the throat, wherein the power face comprises bifurcated tips forming a main indent between the bifurcated tips, upwardly curving lateral edges, a main channel beginning near the throat and extending along the center of the face between the bifurcated tips and opening at a distal end of the blade, and a plurality of side channels connected to the main channel.

In one configuration, the paddle further comprises a shaft. In another aspect, the paddle further comprises lateral edges curving upwardly from the main channel. In another aspect, at least a portion of the upwardly curving lateral edges curve to an angle that is substantially perpendicular to the power face. In another aspect, at least a portion of the upwardly curving lateral edges curve to an angle wherein the lateral edge of the blade is in a plane parallel to the direction of force that is applied to the power face when paddling through water. In another aspect, the blade gradually tapers outwardly from the throat.

In another aspect, the side channels extend inwardly from near the lateral edges downwardly toward and into the main channel. In yet another aspect, the side channels comprise a trough in the power face of the blade, and the side channels funnel into the main channel, wherein the main channel comprises a trough in the power face of the blade. In another aspect, the main channel and the side channels are molded from a moldable planar sheet of fabrication material. In another aspect, the main channel and the side channels are carved into a sheet of fabrication material.

In another aspect, at least a portion of the upwardly curving lateral edges curve to an angle that is substantially perpendicular to the power face. In another aspect, at least a portion of the upwardly curving lateral edges curve to an angle wherein the lateral edge of the blade is in a plane parallel to the direction of force that is applied to the power face when paddling through water.

In one configuration, the paddle has bifurcated tips. In one aspect, the bifurcated tips are each rounded at a distal tip. In another aspect, the rounded bifurcated tips are symmetrical. In another aspect, each of the bifurcated tips is spoon-shaped, having upwardly curving outer edges and an upwardly curving distal tip. In another aspect, each of the spoon-shaped bifurcated tips, when paddling water, directs water flow downwardly toward the distal tip of the blade and inwardly toward the main channel. In another aspect, each of the spoon-shaped bifurcated tips, when paddling water, directs water flow downwardly toward the distal tip of the blade and inwardly toward at distal tip of the blade.

In one configuration, the blade gradually tapers outwardly beginning at the throat. In another configuration, the side channels extend inwardly from near the lateral edges downwardly toward and into the main channel. In yet another configuration, the side channels comprise an indentation in the power face of the blade, and the side channels funnel into the main channel, wherein the main channel comprises an indentation in the power face of the blade. In yet another configuration, each bifurcated tip is bifurcated, forming a side indent.

The features described above provide a significant improvement in performance in the paddle, including a significant reduction in flutter or sideways movement of the paddle during the power stroke.

BRIEF DESCRIPTION OF THE DRAWINGS

Various embodiments of the present invention are shown and described in reference to the numbered drawings wherein.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

It is understood that use of definite articles such as "the" or "a" shall be construed to include one or more elements and shall not be construed to be limited to a single element. Elements shall be limited to single elements only if expressly modified by a term such as "single", "one", "sole", "only", or the like.

Disclosed herein are novel watersport paddles having improved performance properties. The watersport paddles described herein may be used as an oar or paddle to propel any type of watercraft, including, but not limited to, a canoe, row boat, kayak, outrigger, zodiac, stand up paddle board, and the like. It will be appreciated that numerous changes may be made to the present invention without departing from the scope of the claims, including various combinations of the individual features and elements described below.

Watersport paddles (generally referred to herein as a "paddle") generally comprise one or two blades connected to a shaft. The shaft may include a grip, which may be of any one of various suitable shapes, including pear shape, T-shape or other variation. Paddles having blades at both ends (i.e., a kayak paddle) may include grips in the form of a non-slip sleeve where hands are positioned on the paddle. The shaft of the paddle may be straight or bent, and may be of any one of various lengths and materials. The blade of a paddle is the wide flat portion at the end of the shaft that is placed in the water and used to propel the user forward. The blade may be long and narrow, short and wide, or any variation in between. A blade has two faces: a power face and a back face. The power face is the face of the blade that impinges water during a paddle stroke. The back face is the face opposite the power face.

Figure 1:
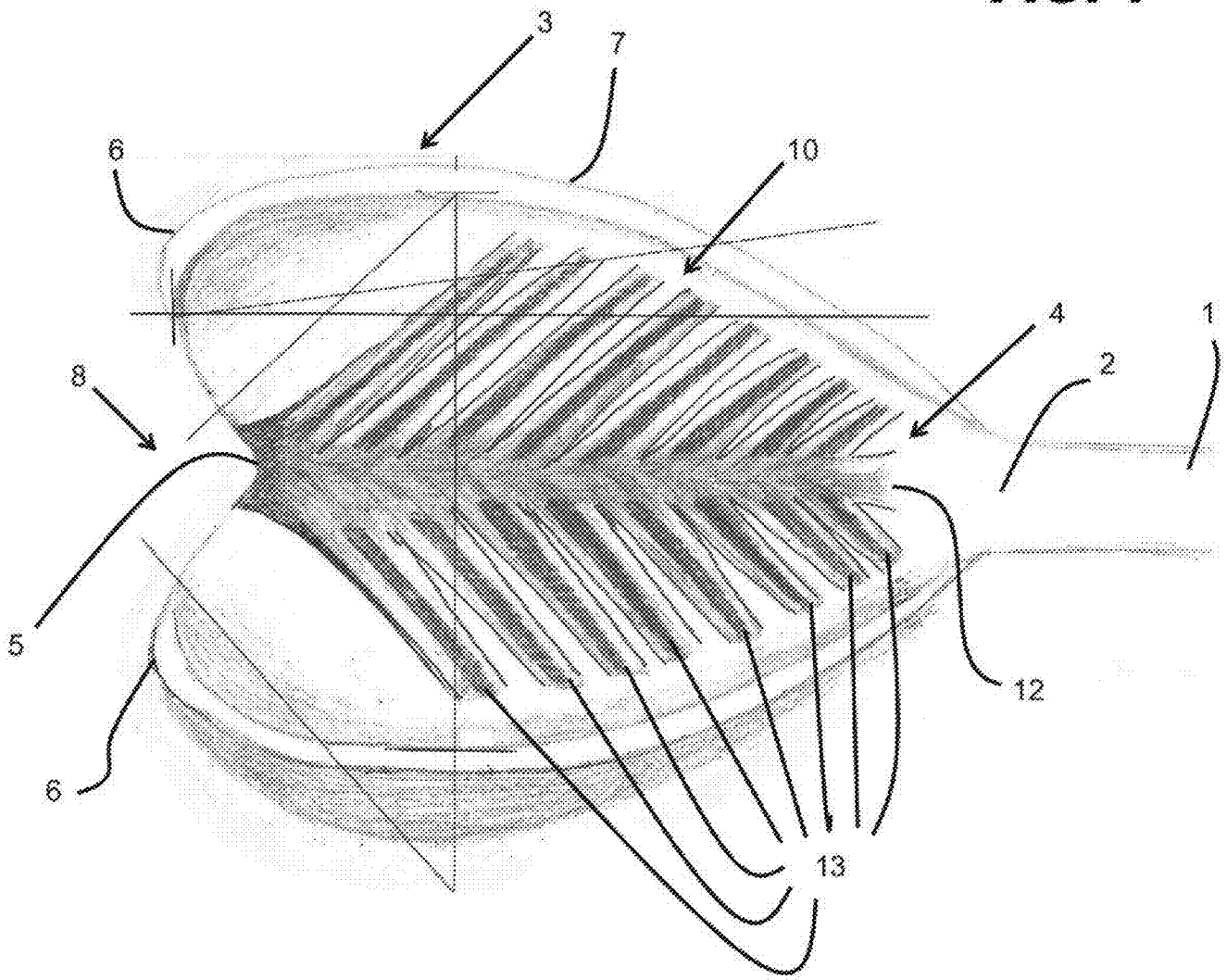
FIG. 1 shows a front view of a watersport paddle described and claimed herein.
Figure 2:
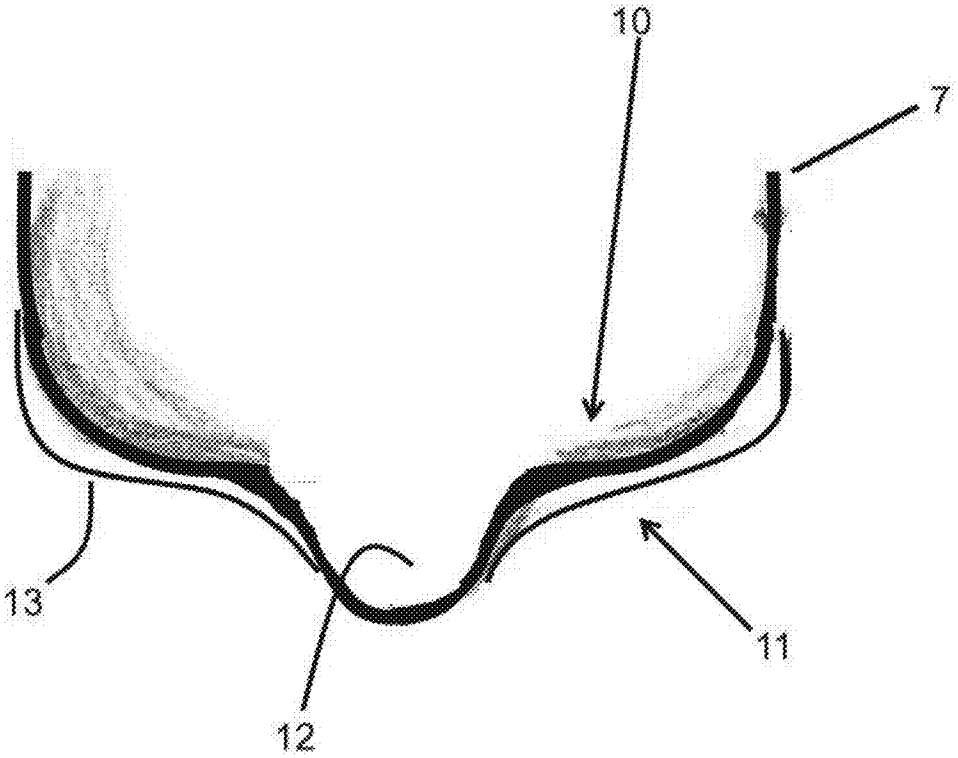
FIG. 2 shows an end view of the watersport paddle of FIG. 1.

Turning now to the drawings, and more particularly to FIGS. 1 and 2 thereof, a watersport paddle in accordance with this invention is shown having a shaft 1 and a blade 3 having a throat 2, wherein the blade is connected to the shaft via the throat 2 of the blade at an end of the shaft 1. In a different configuration, such as for use as a kayak paddle or a stand up paddle board paddle, the shaft 1 may comprise a blade 3 at each end of the shaft 1. The paddle shafts and blades, and the interlocking coupling, may be formed of any suitable material. For example, the shafts may be formed using polypropylene, reinforced with woven glass fibers, which may be bonded with resin, braided carbon fiber, aramid fibers, and/or a composite of E-glass or S-Glass and/or carbon fiber materials, such as a carbon fiber/epoxy tube. Other shaft materials such as fiber glass/epoxy or pultruded fiberglass and carbon fiber/epoxy may be used to reduce the cost of the paddle and improve toughness. The strength-to-weight and stiffness-to-weight ratios of carbon fiber/epoxy are generally regarded as superior. In one specific configuration, the carbon fiber/epoxy shaft 1 has a wall thickness of about 0.055" and an outside diameter of about 1.25" which is convenient for the average man's hand. In other configurations, smaller shafts, on the order of one inch, can be used for paddlers having smaller hands such as children and some women. A thicker paddle shaft wall thickness can be used to obtain greater strength, primarily of interest to whitewater kayakers, but at a greater weight and cost. An indexing flat (not shown) may be formed as a generally flat portion along the shaft 1 at the position of one or both hands when gripping the paddle to assist the paddler in orienting the paddle in his hands for the optimal angle of the blade 3 with respect to the water surface. The blades 3 can be permanently bonded to the shaft 1, or may be removably connected to the shaft 1 by means of a fastener, such as a bolt, screw, threaded connection, or by a spring pin (for example, a spring pin on the throat 2 that springs outwardly and engages and locks into a hole in the shaft when the throat is inserted into the interior of the shaft). The blades may be formed, as an example only, from polypropylene with a urethane or PVC foam core. The interlocking coupling mechanism may be formed of plastic or metal or other materials as suited to a particular application.

Figure 3:
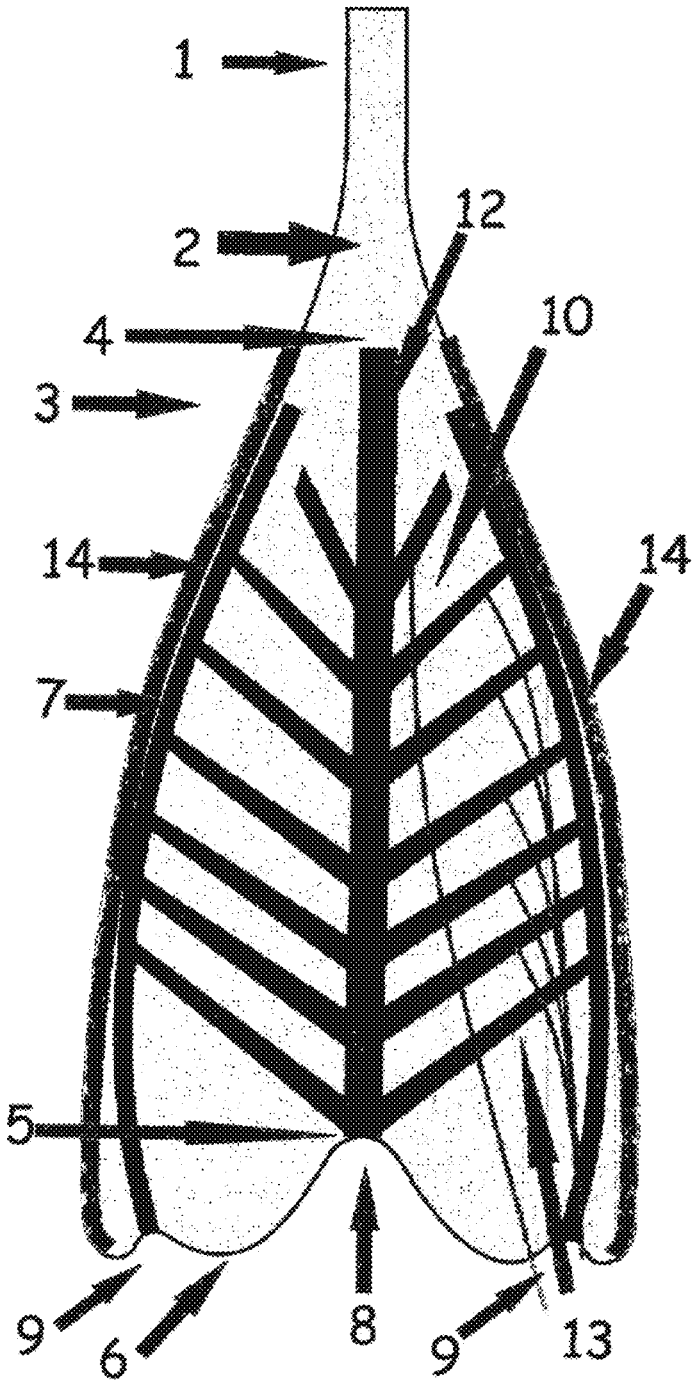
FIG. 3 shows a front view of an alternate embodiment of a watersport paddle.
Figure 5:
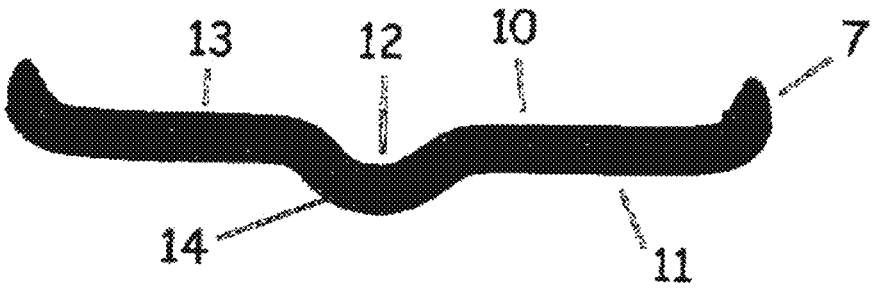
FIG. 5 is an end view of the paddle of FIG. 3.

The various aspects of the present invention are shown in FIGS. 2 and 3. The blade 3 is generally spoon-shaped, having a generally concave power face 10 and a generally convex back face 11. The blade 3 has a proximal end 4 integral with the throat 2 (which is connected to the shaft 1), lateral edges 7 forming the outer perimeter of the blade 3, and a distal end 5 which forms the tip of the blade 3. The blade 3 may be substantially curved, as shown in FIGS. 2 and 3, or may be substantially flat, as shown in FIG. 5. The blade 3 can be made of any material suitable for the purpose of the watersport paddle, taking into consideration such factors as weight, strength, stiffness, durability, performance, paddling cadence, and the like. In one possible configuration, the blade 3 may be made of carbon fiber fabric/epoxy, approximately 0.70" thick. Other combinations of fiber materials such as glass fiber fabric and Kevlar and carbon fiber fabric may be used to provide desired properties of strength, stiffness, toughness and light weight. The fiber materials are normally used in fiber mats, performed to the desired thickness, length and width. Another material, heretofore unused in kayak paddles, has produced excellent kayak paddle blades is a thermoplastic material known as Twintex. It is woven from glass fibers individually coated with a thin film of polypropylene, and has the advantage that it does not outgas during molding, does not require curing time, and is tough and light weight.

The watersport paddle disclosed herein may be adapted to various blade shapes and dimensions, depending on the various paddling environments and paddler strengths. For example, a typical sea kayak paddle blade for an expedition sea kayaker may be configured to be about 20.5" long and about 6.5" wide. Sea kayakers desiring more relaxed and shorter distances will usually select a narrower and sometimes longer paddle blade. Whitewater kayakers usually prefer a shorter, wider blade, e.g. 7.5" wide and 19" long. The particular features of the watersport paddle disclosed and claimed herein may easily accommodate these various blade shapes and dimensions.

The various elements and features of the invention disclosed and claimed herein are illustrated in FIGS. 1 and 2. In one configuration, the invention relates to a watersport paddle blade 3 comprising a throat 2 configured to attach to a shaft 1, where the power face 10 is attached or connected to the throat. The power face 10 comprises a center channel 12, comprising a trough or recess relative to the primary surface of the power face, beginning at or near the throat 2 at the proximal end of the blade 3 and extending along the center of the power face 10 and opening at a distal end 5 of the blade 3 between the bifurcated tips. In some embodiments, the main channel has a depth that is tapered from the throat to the distal end, wherein the depth of the main channel is less than or more shallow at the throat than at the distal end.

In another configuration, the invention relates to a watersport paddle blade comprising a throat configured to attach to a shaft, a power face attached to the throat, upwardly curving lateral edges, a main channel beginning near the throat and extending along the center of the face between the bifurcated tips and opening at a distal end of the blade, and a plurality of side channels connected to the main channel, wherein the power face comprises bifurcated tips 6.

The center channel comprises a furrow or trough-like depression or indentation or recess in the power face 10 of the blade 3, relative to the face of the blade. In one configuration, the depth of the center channel 12 is tapered and varies along the length of the blade 3, ranging from a relatively shallow depth at the proximal end 4 to a greater depth at the distal end 5. In this embodiment, the depth of the side channels is tapered such that the depth of the side channel near the lateral edges is less than or more shallow than the depth of the side channel at the point where it opens into the main channel. The center channel 12 may be fabricated into the power face 10 by means of molding the blade 3 so as to form the center channel 12, as shown in FIG. 2. Alternatively, the center channel 12 may be fabricated into the power face 10 by means of carving the center channel 13 into the material of the blade. For example, the center channel may be carved into a blade made of wood or a thick piece of plastic. The center channel may also vary in width, depth, or both, from the proximal end to the distal end. For example, at the proximal end near the throat the center channel may be relatively narrow and shall at the proximal end, and then gradually expand in width and depth as it approaches the distal end.

In another configuration, the watersport paddle may also comprise a plurality of side channels 13 connected to the center channel 12. The side channels 13 extend inwardly from near the lateral edges 7 of the blade 3 angled downwardly toward the distal end of the blade and into the main channel. The side channels 13 function to feed water from the outer lateral edges 7 inwardly toward the center channel 12, while simultaneously directing water downwardly toward the distal end 5 of the blade 3. In another configuration, the side channels comprise an indentation in the power face of the blade, and the side channels funnel into the main channel, wherein the main channel also comprises an indentation in the power face of the blade. In one configuration, the side channels 13 comprise furrows or recesses or trough-like depressions in the power face 10 of the blade 3. The side channels 13 may be fabricated into the power face 10 by means of molding the blade 3 so as to form the channels. For example, the center channel and the side channels can be molded from a moldable planar sheet of fabrication material. Alternatively, the side channels 13 may be fabricated into the power face 10 by means of carving the channels 13 into a sheet of fabrication material. For example, the channels may be carved into a blade made of wood or a thick piece of plastic. In one configuration, the side channels 13 comprise channels of gradually deeper furrows, beginning with a relatively shallow depth near the lateral edges 7 of the blade 3 and gradually getting deeper as the side channel approaches the center channel 12. In one configuration, the depth of the side channel 13 is approximately the same depth as the center channel at the point where it connects to the center channel 12.

In yet another aspect, the side channels extending from the lateral edge to the center channel are angled to slope downwardly toward the distal end of the blade 3. For example, the side channels are configured to channel water inwardly toward the center channel and also downwardly toward the distal end of the spoon-shaped blade. The angle of the side channels relative to the center channel may be from about 5° to about 80°, from about 10° to about 75°, from about 15° to about 70°, from about 20° to about 65°, from about 25° to about 60°, from about 30° to about 55°, from about 35° to about 50°, or about 45°.

In another aspect of the invention, the paddle blade further comprises lateral edges curving upwardly from the main channel. FIG. 2, which is an end view of a paddle blade made in accordance with the present invention, illustrates the upwardly curved lateral edges 7 on both sides of the blade 3, which form a scoop or spoon-like blade. In one configuration, at least a portion of the upwardly curving lateral edges curve to an angle wherein the lateral edge of the blade is in a plane parallel to the direction of force that is applied to the power face when paddling through water, such that the lateral edge cuts through the water at a 0° angle. In another configuration, at least a portion of the upwardly curving lateral edges curve to an angle that is substantially perpendicular to the power face. In another configuration, at least a portion of the upwardly curving lateral edges curve to an angle that is less than perpendicular to the power face. For example, the lateral edges may curve upwardly at an angle that is 45°, 50°, 55°, 60°, 65°, 70°, 75°, 80°, or 85° relative to the plane or power face of the blade.

In another configuration, the angle of the upwardly curved lateral edges may vary along the length of the blade, ranging from no angle or a shallower angle near the proximal end 4 to a steeper angle near the distal end 5.

Figure 4:
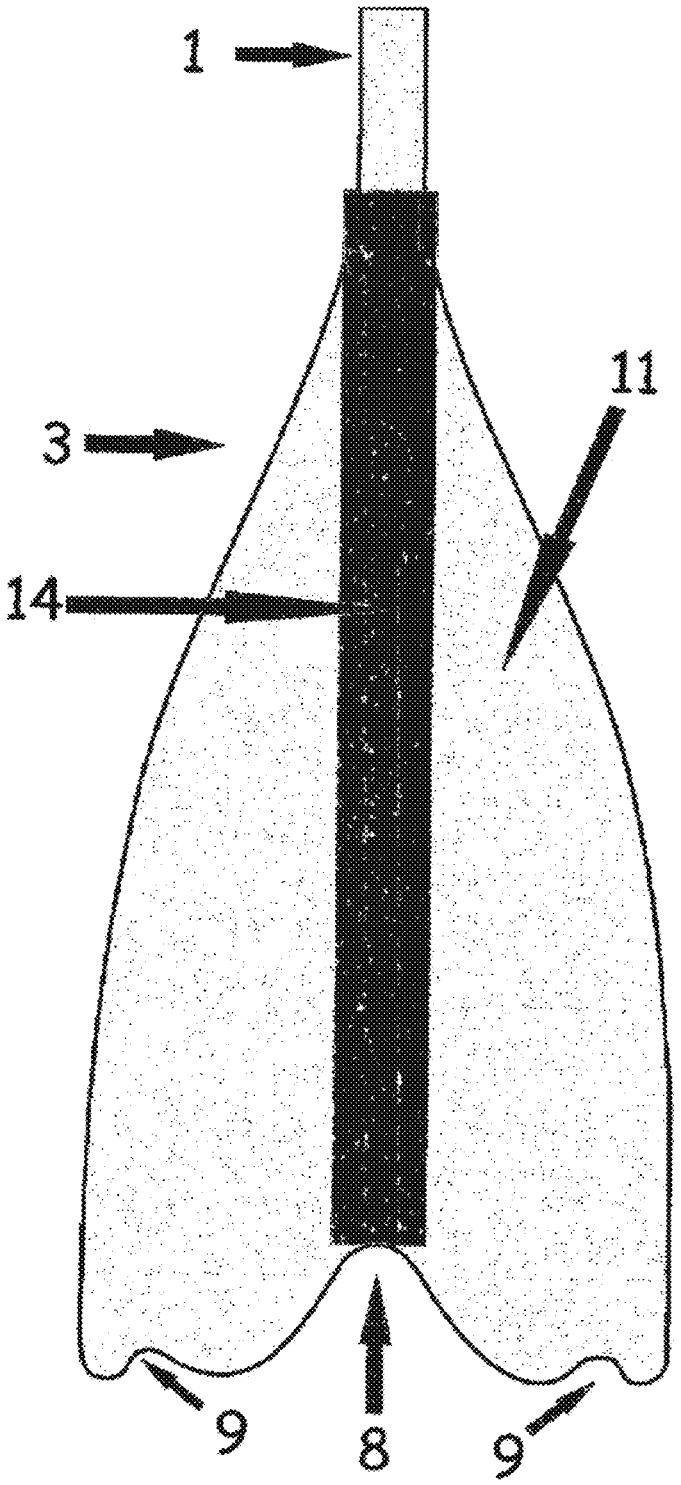
FIG. 4 is a back view of the paddle of FIG. 3.

In another aspect, the paddle blade 3 gradually tapers outwardly from the throat 2, to a maximum width, then tapering or curving inwardly at the distal end 5 to form bifurcated tips 6. The bifurcated tips are configured to create an open channel 8 between the bifurcated tips 6 to direct flow of water out of the center channel 12 as it exits between the bifurcated tips. In one configuration, the bifurcated tips 6 are each rounded at the end of the tips. In another configuration, the bifurcated tips are pointed, having an angled corner. In yet another configuration, the bifurcated tips are configured to be flexible so as to function similar to a flexible fin. In yet another embodiment, the bifurcated tips may be configured with a trifurcated tip (three tips, in between each of which is a channel for directing flow of water). In another configuration, the rounded bifurcated tips are symmetrical. In yet another configuration, each of the bifurcated tips is spoon-shaped, having upwardly curving outer lateral edges and an upwardly curving distal tip 6. In another configuration, each of the spoon-shaped bifurcated tips, when paddling water, directs water flow downwardly toward the distal tip of the blade and inwardly toward the main channel. In another configuration, each of the spoon-shaped bifurcated tips, when paddling water, directs water flow downwardly toward the distal tip of the blade and inwardly toward at distal tip of the blade. In yet another configuration, as shown in FIGS. 3 and 4, each bifurcated tip is bifurcated, forming a side indent in each bifurcated tip on each side of the main indent, thereby creating four tips in the blade. In one particular embodiment, the depth of the main indent 8 (i.e., the dimension from the tip of the blade to the edge of the blade where the main channel exits from the blade) is greater than the depth of the side indents 9 (i.e., the dimension from the tip of the blade to the edge of the blade where the side indent is deepest).

The various blade configurations described above may further comprise a center stiffening rib extending a partial length or the full length of the blade. As noted above, the distal end of the blade may be devoid of any stiffening rib, giving the distal end greater flexibility.

The disclosure set forth above encompasses multiple embodiments. These specific embodiments as disclosed and illustrated herein are not to be considered in a limiting sense as numerous variations are possible. The subject matter of the present disclosure includes all novel and non-obvious combinations and subcombinations of the various elements, features, functions and properties disclosed herein, and equivalents of them. Where the claims recite "a" or "a first" element or the equivalent thereof, it is within the scope of the present disclosure that such claims may be understood to include incorporation of one or more such elements, neither requiring nor excluding two or more such elements.

The claims in the present disclosure are directed to certain combinations and subcombinations and are believed to be novel and non-obvious. Other combinations and subcombinations of features, functions, elements and properties may be claimed through amendment of those claims or presentation of new claims in this or a related application. Such amended or new claims, whether different, broader, narrower or equal in scope to the original claims, are also regarded as included within the subject matter of the present disclosure.

Numerous modifications and variations of the preferred embodiment described above are possible and will become apparent to those skilled in the art in light of this specification. Moreover, many functions and advantages are described for the preferred embodiment, but in many uses of the invention, not all of these functions and advantages would be needed.

Therefore, we contemplate the use of the invention using fewer than the complete set of noted features, process steps, benefits, functions and advantages. For example, all the process elements may be used to produce a particular part that requires the characteristics provided by each process element, or alternatively, they may be used in combinations that omit particular process elements or substitute others to give the desired characteristics of the part. Moreover, several species and embodiments of the invention are disclosed herein, but not all are specifically claimed, although all are covered by generic claims. Nevertheless, it is our intention that each and every one of these species and embodiments, and the equivalents thereof, be encompassed and protected within the scope of the following claims, and no dedication to the public is intended by virtue of the lack of claims specific to any individual species. Accordingly, it is expressly intended that all these embodiments, species, modifications and variations, and the equivalents thereof, in all their combinations, are to be considered within the spirit and scope of the invention as defined in the following claims.

The invention claimed is:

1. A watersport paddle blade comprising a throat configured to attach to a shaft;

a power face attached to the throat, wherein the power face comprises:

a recessed main channel beginning at or near the throat, extending along the center of the face and opening at a distal end of the blade, and a plurality of recessed side channels connected to the main channel, wherein the side channels extend inwardly from near the lateral edges angled downwardly toward the distal end of the blade into the main channel.

2. The paddle blade of claim 1, further comprising lateral edges curving upwardly.

3. The paddle blade of claim 1, wherein at least a portion of the upwardly curving lateral edges curve to an angle that is substantially perpendicular to the power face.

4. The paddle blade of claim 1, wherein the lateral edges of the power face of the blade gradually taper outwardly from the throat.

5. The paddle blade of claim 1, wherein the depth of the side channels is tapered such that the depth of the side channels near the lateral edges is less than the depth of the side channel at the point where it opens into the main channel.

6. The paddle blade of claim 1, wherein the side channels comprise a recess in the power face of the blade, and the side channels funnel into the main channel, wherein the main channel comprises a trough in the power face of the blade.

7. The paddle blade of claim 1, wherein the main channel has a depth that is tapered from the throat to the distal end, wherein the depth of the main channel at the throat is less than the depth of the main channel at the distal end.

8. A watersport paddle blade according to claim 1, wherein the power face comprises bifurcated tips forming a main indent between the bifurcated tips and upwardly curving lateral edges.

9. The paddle blade of claim 8, wherein at least a portion of the upwardly curving lateral edges curve to an angle that is substantially perpendicular to the power face.

10. The paddle blade of claim 8, wherein the depth of the side channels is tapered such that the depth of the side channel near the lateral edges is more shallow than the depth of the side channel at the point where it opens into the main channel.

11. The paddle blade of claim 8, wherein the main channel has a depth that is tapered from the throat to the distal end, wherein the depth of the main channel is at the throat is less than the depth of the main channel at the distal end.

12. The paddle blade of claim 8, wherein the bifurcated tips are each rounded at a distal tip.

13. The paddle blade of claim 12, wherein the rounded bifurcated tips are symetrical.

14. The paddle blade of claim 8, wherein each of the bifurcated tips is spoon-shaped, having upwardly curving outer edges and an upwardly curving distal tip.

15. The paddle blade of claim 14, wherein each of the spoon-shaped bifurcated tips, when paddling water, directs water flow downwardly toward the distal tip of the blade and inwardly toward the main channel.

16. The paddle blade of claim 15, wherein each of the spoon-shaped bifurcated tips, when paddling water, directs water flow downwardly toward the distal tip of the blade and inwardly toward at distal tip of the blade.

17. The paddle blade of claim 8, wherein each bifurcated tip is bifurcated, forming a side indent at each side of the main indent.

* * * * *